US005106578A

United States Patent [19]

Ohtsuka et al.

[11] Patent Number: 5,106,578

[45] Date of Patent: Apr. 21, 1992

[54] CAST-TO-NEAR-NET-SHAPE STEEL BODY OF HEAT-RESISTANT CAST STEEL

[75] Inventors: Kouki Ohtsuka; Kimio Kubo, both of Tochigi; Koichi Akiyama, Tokyo; Masahide Ike, Kanagawa; Kunio Kawai, Kanagawa, all of Japan

[73] Assignees: Hitachi Metals Ltd.; Nissan Motor Co., Ltd., both of Tokyo, Japan

[21] Appl. No.: 620,016

[22] Filed: Nov. 30, 1990

Related U.S. Application Data

[62] Division of Ser. No. 402,034, Sep. 5, 1989, abandoned.

[30] Foreign Application Priority Data

| | | | |
|---|---|---|---|
| Sep. 5, 1988 | [JP] | Japan | 63-220414 |
| Sep. 5, 1988 | [JP] | Japan | 63-220415 |
| Oct. 14, 1988 | [JP] | Japan | 63-257280 |

[51] Int. Cl.[5] ..... C22C 38/26

[52] U.S. Cl. ..... 420/68; 420/69; 420/70

[58] Field of Search ..... 148/325; 42/68, 69, 42/70

[56] References Cited

U.S. PATENT DOCUMENTS

| | | | |
|---|---|---|---|
| 3,029,171 | 4/1962 | Rostoker et al. | 420/68 |
| 3,700,432 | 8/1970 | Brickner | 420/68 |
| 4,726,853 | 2/1988 | Gressin et al. | 420/68 |

FOREIGN PATENT DOCUMENTS

| | | |
|---|---|---|
| 212628 | 7/1956 | Australia . |
| 667630 | 11/1938 | Fed. Rep. of Germany . |
| 907008 | 9/1962 | United Kingdom . |
| 1205250 | 9/1970 | United Kingdom . |
| 1207603 | 10/1970 | United Kingdom . |

*Primary Examiner*—Deborah Yee
*Attorney, Agent, or Firm*—Finnegan, Henderson, Farabow, Garrett & Dunner

[57] ABSTRACT

The present invention relates to a heat-resistant cast steel that comprises, on a weight basis, 0.06–0.20% C, 0.01–0.10% N, 0.4–2.0% Si, 0.3–1.0% Mn, not more than 0.04% P, not more than 0.04% S, 15–22% Cr, 0.01–2.0% Nb, with the balance being Fe and incidental impurities, and further preferably that is retained at a temperature not higher than the temperature of two-phase mixed region for a certain time and then is gradually cooled, after casting;

a heat-resistant cast steel that comprises, on a weight basis, 0.06–0.20% C, 0.01–0.10% N, 0.4–2.0% Si, 0.3–1.0% Mn, not more than 0.04% P, not more than 0.04% S, 15–22% Cr, 0.01–2.0% Nb, 0.2–1.0% Mo, with the balance being Fe and incidental impurities, and further preferably that is retained at a temperature not higher than the temperature of two-phase mixed region for a certain time and then is gradually cooled, after casting;

a heat-resistant cast steel that comprises on a weight basis, 0.06–0.20% C, 0.01–0.10% N, 0.4–2.0% Si, 0.3–1.0% Mn, not more than 0.04% P, not more than 0.04% S, 15–22% Cr, 0.01–0.10% Ti, 0.2–1.0% Mo, 0.01–1.0% Ni, with the balance being Fe and incidental impurities, and further preferably that is retained at a temperature not higher than the temperature of two-phase mixed region for a certain time and then is gradually cooled, after casting; and a heat-resistant cast steel that comprises, on a weight basis, 0.06–0.20% C, 0.01–0.10% N, 0.4–2.0% Si, 0.3–1.0% Mn, not more than 0.04 P, not more than 0.04% S, 15–22% Cr, 0.01–0.10% Ti, 0.2–1.0% Mo, 0.01–1.0% Ni, with the balance being Fe and incidental impurities, and further preferably that is retained at a temperature not higher than the temperature of two-phase mixed region for a certain time and then is gradually cooled, after casting.

5 Claims, 2 Drawing Sheets

CAST-TO-NEAR-NET-SHAPE STEEL BODY OF HEAT-RESISTANT CAST STEEL

This is a continuation of application Ser. No. 07/402,034, filed Sept. 5, 1989, now abandoned.

BACKGROUND OF THE INVENTION

The present invention relates to heat-resistant cast steels, more particularly, to heat-resistant cast steels that have excellent durability (e.g. high resistance to thermal fatigue and oxidation) and that can be produced at low cost because of their good castability and machinability.

Conventional heat-resistant cast iron and cast steel include those which are shown under the heading of "Comparative Samples" in Table 1 provided herein. Automotive engine exhaust parts such as exhaust manifolds, turbocharger housings, precombustion chambers for diesel engines and parts of exhaust purifying systems are normally used under hot and hostile conditions and, to meet this operational requirement, they have conventionally been made of heat-resistant cast irons such as high-Si spheroidal graphite cast iron and Ni-Resist cast iron (see Table 1) and aluminum-alloyed cast iron, and in special cases, expensive high-alloy content heat-resistant cast steels such as austenitic stainless cast steels.

Such conventional heat-resistant cast irons and cast steels, however, have had various problems. For example, high-Si spheroidal graphite cast iron, Ni-Resist cast iron and ferritic stainless cast steels such as CB-30 (designated according to the Alloy Casting Institute Standards) insure fairly high productivity because of their good castability and machinability but on the other hand, the durability such as resistance to thermal fatigue and oxidation is so poor that it is not suitable for use in parts that is to be exposed to a temperature of not less than 800° C. Aluminum-alloyed cast irons and high-alloy content heat-resistant cast steels such as austenitic stainless cast steels exhibit high durability at a temperature of 800° C. or more but they are so poor in castability that defects such as shrinkage cavities and misruns are highly likely to occur during casting. These casting defects combine with the poor machinability of the aluminum-alloyed cast irons and high-alloy content heat-resistant cast steels to reduce their productivity.

SUMMARY OF THE INVENTION

The principal object, therefore, of the present invention is to solve the aforementioned problems of the prior art.

According to its first aspect, the present invention solves the problems of the prior art by a heat-resistant cast steel that comprises, on a weight basis, 0.06%-0.20% C, 0.01%-0.10% N, 0.4%-2.0% Si, 0.3%-1.0% Mn, not more than 0.04% P, not more than 0.04% S, 15%-22% Cr, 0.01%-2.0% Nb, with the balance being Fe and incidental impurities, and further preferably that is retained at a temperature not higher than the temperature of two-phase mixed region for a certain time and then is gradually cooled, after casting.

According to its second aspect, the present invention solves the problems of the prior art by a heat-resistant cast steel that comprises, on a weight basis, 0.06%-0.20% C, 0.01%-0.10% N, 0.4%-2.0% Si, 0.3%-1.0% Mn, not more than 0.04% P, not more than 0.04% S, 15%-22% Cr, 0.01%-2.0% Nb, 0.2%-1.0% Mo, with the balance being Fe and incidental impurities, and further preferably that is retained at a temperature not higher than the temperature of two-phase mixed region for a certain time and then is gradually cooled, after casting.

According to its third aspect, the present invention solves the problems of the prior art by a heat-resistant cast steel that comprises, on a weight basis, 0.06%-0.20% C, 0.01%-0.10% N, 0.4%-2.0% Si, 0.3%-1.0% Mn, not more than 0.04% P, not more than 0.04% S, 15%-22% Cr, 0.01%-0.10% Ti, 0.2%-1.0% Mo, 0.01%-1.0% Ni, with the balance being Fe and incidental impurities, and further preferably that is retained at a temperature not higher than the temperature of two-phase mixed region for a certain time and then is gradually cooled, after casting.

According to its fourth aspect, the present invention solves the problems of the prior art by a heat-resistant cast steel that comprises, on a weight basis, 0.06%-0.20% C, 0.01%-0.10% N, 0.4%-2.0% Si, 0.3%-1.0% Mn, not more than 0.04 P, not more than 0.04% S, 15%-22% Cr, 0.01%-2.0% Nb, 0.01%-0.10% Ti, 0.2%-1.0% Mo, 0.01%-1.0% Ni, with the balance being Fe and incidental impurities, and further preferably that is retained at a temperature not higher than the temperature of two-phase mixed region for a certain time and then is gradually cooled, after casting.

DETAILED DESCRIPTION OF THE INVENTION

Figure 1:
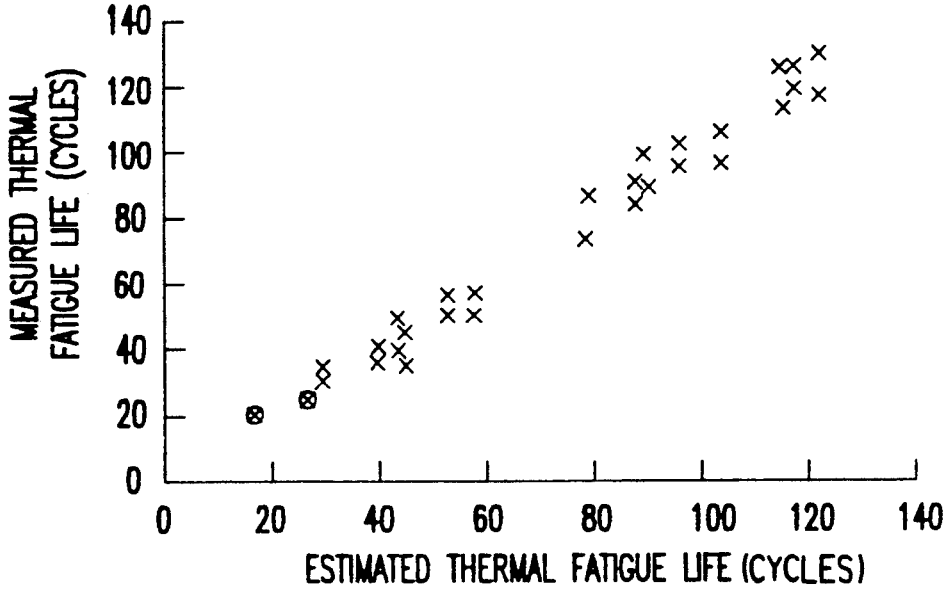
FIG. 1 is a graph showing the relationship between values of thermal fatigue life as estimated by the equation of multiple regression and measured values.

With a view to solving the aforementioned problems of the prior art, the present inventions performed factorial analyses on resistance to thermal fatigue and oxidation and have come up with the compositional ranges set forth above.

Further, the heat-resistant cast steel which is obtained by the compositional ranges set forth above is preferably retained at a temperature of preferably about 1400° C. or less and more preferably from 750° to 950° C. of two-phase mixed region (i.e., a phase region in which ferrite and austenite are mixed) for preferably from 0.5 to 3 hours and then is gradually cooled at the rate of preferably 50° C./min or less by means such as an enforced blow, a standing at a room temperature and a standing in a furnace.

By adopting these compositions, it has become possible to provide heat-resistant cast steels that are comparable to conventional heat-resistant cast irons in productivity characteristics such as castability, machinability and low cost production, and that yet possess resistance to thermal fatigue and oxidation which is comparable to that of conventional high-alloy content heat-resistant cast steels such as stainless cast steels.

The criticality of the compositional range of each of the alloying elements incorporated in the heat-resistant cast steel of the present invention is described in detail below.

C (carbon) : 0.06–0.20 wt %

As a result of multiple regression analyses based on the data shown in Tables 1 and 2 provided hereinafter, the present inventors found that the thermal fatigue resistance of ferritic stainless cast steels were governed more predominantly by high-temperature strength than by breaking extension which had conventionally been important.

To provide improved strength at high temperatures, the carbon content is preferably increased to a certain extent on the condition that graphite is not formed.

Carbon which is effective in providing improved castability (melt flowability) of forging must be present in an amount of at least 0.06 wt %. On the other hand, the carbon content which is closely related to the contents of other elements such as in particular, Cr should not exceed 0.20 wt % and this is in order to prevent the decrease in resistance to thermal fatigue due to local thermal stress which might develop upon $\alpha$-$\gamma$ phase trasformation.

By limiting the carbon content to lie within the above-defined range, not only can resistance to oxidation be improved but also the precipitation of a Cr carbide that would otherwise cause decrease in corrosion resistance and machinability can be prevented.

N (nitrogen): 0.01–0.10 wt %

Nitrogen is an important element which was found to be effective in improving high-temperature strength and thermal fatigue resistance as a result of analysis of the data shown in Tables 1 and 2. The effectiveness of nitrogen is exhibited when it is present in an amount of at least 0.01 wt %. On the other hand, in order to insure stable production and to avoid embrittlement due to precipitation of $Cr_2N$, the nitrogen content should not exceed 0.10 wt %.

Si (silicon): 0.4–2.0 wt %

Silicon (Si) provides increased structural stability for the Fe-Cr based alloy system of the present invention by narrowing the range of $\gamma$-phase. It is also effective in providing improved oxidation resistance. Silicon has further advantages of improving castability and reducing the number of pinhole defects in castings by acting as a deoxidizer. To attain these effects, silicon must be present in an amount of at least 0.4 wt %. On the other hand, the carbon equivalent including the total carbon content and a corresponding silicon content should not be such that the grains of primary carbides become coarse to impair the machinability of the alloy system or that the Si content in the ferritic base structure becomes excessive to either reduce toughness or promote the formation of $\sigma$-phase at high temperatures. To avoid these problems, the upper limit of silicon content should not exceed 2.0 wt %.

Mn (manganese): 0.3–1.0 wt %

Manganese (Mn) is an element that contributes to the formation of a pearlitic structure and hence is not suitable for use in heat-resistant cast steels of the type contemplated by the present invention which is based on a ferritic structure. However, like Si, manganese is effective as a deoxidizer of forging and should be present in an amount of 0.3–1.0 wt % in order to insure high productivity by improving running flowability during casting.

P (phosphorus): not more than 0.04 wt %

If the phosphorus content exceeds 0.04 wt %, pearlite is formed or steadite is crystallized, to impair the machinability of the ally system. The pearlite and steadite are also impurities that reduce both the corrosion resistance and the thermal fatigue resistance of the alloy. Therefore, the phosphorus content should not exceed 0.04 wt %.

S (sulfur): not more than 0.04 wt %

Sulfur (S) has the potential to provide improved machinability through crystallization of MnS. On the other hand, sulfur is an impurity that reduces the corrosion resistance and thermal fatigue resistance of the alloy system. Therefore, the sulfur content should not exceed 0.04 wt %.

Cr (chromium): 15–22 wt %

Chromium (Cr) is effective in improving oxidation resistance and raising the eutectoid transformation temperature. Further, it has close bearing to the contents of other elements, in particular, carbon in preventing $\alpha$-$\gamma$ phase transformation within the range of operating high temperatures, thereby contributing structural stability to the alloy system. In order to attain these effects, Cr should be incorporated in an amount of at least 15 wt %. On the other hand, if Cr is added in an excessive amount (i.e., more than 22 wt %), the grains of primary Cr carbide will become coarse and the machinability of the alloy will be impaired. Further, excessive addition of Cr will promote the formation of $\sigma$-phase at high temperatures, with subsequent embrittlement of the alloy. Therefore, the upper limit of the Cr content should not exceed 22%.

Nb (niobium): 0.01–2.0 wt % (preferably 0.6–2.0 wt %)

Niobium (Nb) combines with carbon to form a fine particle of carbide that is beneficial to the improvement of both tensile strength at a high temperature and resistance to thermal fatigue Niobium has the additional advantage of providing improved corrosion resistance and machinability by inhibiting the formation of Cr carbides. In order to attain these effects, the Nb content should be at least 0.01 wt %. On the other hand, excessive addition (i.e., more than 2.0 wt %) of Nb results in the formation of carbides at grain boundaries, thus leading to lowered toughness. Therefore, the upper limit of the Nb content should not exceed 2.0 wt %. Preferably, the Nb content is 0.6 to 2.0 wt %.

Mo (molybdenum): 0.2–1.0 wt %

Like C and N, molybdenum (Mo) strengthens the ferrite base to provide improved strength at high temperatures. Therefore, in order to provide improved creep and thermal fatigue resistance, the Mo content should be at least 0.2 wt %. However, if the Mo content exceeds 1.0 wt %, coarse grains of eutectic carbide will form not only to impair machinability but also to cause embrittlement. Furthermore, if Mo is incorporated in an amount exceeding 1.0 wt %, the increase in creep strength becomes small and the decrease of oxidation resistance also results. Therefore, the upper limit of the Mo content is set at 1.0 wt %.

Ti (titanium): 0.01–0.10 wt % (preferably 0.03–0.10 wt %)

Titanium (Ti) is effective in raising the eutectoid transformation temperature. Further, Ti forms a carbide in preference over Cr during casting. In consequence, Ti inhibits not only the formation of primary Cr carbides which impairs machinability but also the precipitation of secondary Cr carbides at high temperatures. Therefore, in order to insure improvement in high-temperature toughness and resistance to both oxidation and corrosion, the Ti content should be at least 0.01 wt %.

On the other hand, if an excessive amount (i.e., more than 0.10 wt %) of Ti is added, it is oxidized so vigorously in atmospheric melting that the efficiency of casting operations is remarkably reduced. Therefore, in consideration of the carbon content, the upper limit of the Ti content is set at 0.1 wt %. Preferably, the Ti content is 0.03 to 0.10 wt %.

Ni (nickel): 0.01-1.0 wt %

Nickel (Ni) is effective in providing improved toughness and corrosion resistance and in consideration of cost and structural stability at a high temperature, the Ni content is limited to lie within the range of 0.01-1.0 wt %.

The heat-resistant cast steel which is obtained by the compositional range and the treatment of the present invention as described above is particularly preferably used for automotive engine exhaust parts such as exhaust manifolds, turbocharger housings, precombustion chambers for diesel engines and parts of exhaust purifying systems in addition to parts which is generally used at high temperatures.

The following examples are provided for the purpose of further illustrating the present invention but are in no way to be taken as limiting.

EXAMPLE 1

This is an example of the present invention as set forth in claim 1. A total of seven specimens to be subjected to evaluation of various characteristics were prepared by casting; three of them were samples of the present invention designated Nos. 1-3 and the remaining four were comparative samples designated Nos. 1-4. The chemical compositions of the respective samples are shown in Table 1.

The casting materials of all samples were atmospherically-melted in a high-frequency 100 kg furnance, which were immediately followed by tapping at 1550° C. or more and pouring into the mold at 1500° C. or more to cast Y-shaped blocks of a size corresponding to JIS type A.

The castings were retained at 800° C. for 2 hours in a heating furnance and were subsequently cooled in air.

Comparative sample Nos. 1-4 shown in Table 1 were of those types which were used in heat-resistant parts such as automotive turbocharger housings and exhaust manifolds. Comparative sample No. 1 was high-Si spheroidal graphite cast iron; comparative sample No. 2 was a Ni-Resist spheroidal graphite cast iron; comparative sample No. 3 was CB-30 specified in the ACI (Alloy Casting Institute) Standards; and comparative sample No. 4 was a kind of austenitic heat-resistant cast steel (equivalent of JIS SCH 12).

The dash mark "-" in Table 1 means that no analysis was made.

TABLE 1

| Specimen | | Chemical composition (wt %) | | | | | | | | | |
|---|---|---|---|---|---|---|---|---|---|---|---|
| | | C | N | Si | Mn | P | S | Cr | Mo | Ni | Nb |
| Sample No. | 1 | 0.07 | 0.029 | 0.74 | 0.53 | 0.019 | 0.008 | 19.1 | — | nil | 0.58 |
| | 2 | 0.15 | 0.037 | 1.26 | 0.45 | 0.019 | 0.007 | 19.8 | — | nil | 1.24 |
| | 3 | 0.19 | 0.051 | 0.88 | 0.37 | 0.018 | 0.007 | 19.4 | — | nil | 1.51 |
| Comparative sample No. | 1 | 3.35 | — | 4.10 | 0.38 | 0.024 | 0.010 | nil | 0.59 | — | — |
| | 2 | 2.15 | — | 4.78 | 0.42 | 0.019 | 0.008 | 1.84 | — | 34.9 | — |
| | 3 | 0.27 | — | 1.35 | 0.37 | 0.021 | 0.011 | 19.5 | — | nil | nil |
| | 4 | 0.25 | — | 1.43 | 0.50 | 0.022 | 0.011 | 19.4 | — | 9.8 | — |

TABLE 2

| Specimen | | Thermal fatigue life (cycles) | | Tensile test at high temp. | | | Oxidation test |
|---|---|---|---|---|---|---|---|
| | | 1st test run | 2nd test run | tensile strength (kg/mm²) | yield strength (kg/mm²) | elongation (%) | (mg/cm²) |
| Sample No. | 1 | 68 | 45 | 4.6 | 2.7 | 61 | 1 |
| | 2 | 44 | 57 | 4.9 | 3.0 | 69 | 1 |
| | 3 | 49 | 62 | 5.4 | 3.2 | 73 | 1 |
| Comparative sample No. | 1 | 8 | 10 | 3.8 | 2.0 | 34 | 205 |
| | 2 | 22 | 24 | 8.5 | 4.1 | 45 | 19 |
| | 3 | 20 | 19 | 4.4 | 2.5 | 57 | 1 |
| | 4 | 37 | 32 | 13.1 | 7.2 | 28 | 2 |

The cast samples having the compositions shown in Table 1 were subjected to various evaluation tests as described below.

The samples were first subjected to a thermal fatigue test using a tester of an electrical-hydraulic servo system. The test pieces were round bars having a distance of 20 mm between gage points and a diameter of 10 mm through gage points. With thermal elongation restricted completely by mechanical means, the test pieces were subjected to repeating heat cycles consisting of heating to 900° C. and cooling to 100° C., with one cycle being continued for 12 min, until they were broken by thermal fatigue.

With a view to analyzing factors that would govern resistance to thermal fatigue, all the specimens were subjected to a tensile test at 900° C. and an oxidation test which consisted of holding round bars (diameter: 14 mm, length: 80 mm) in air at 900° C. for 200 hours. After the oxidation test, the test pieces were shot-blasted to remove the oxide scale and the weight loss due to oxidation in terms of a change in weight per initial unit surface area (mg/cm²) was measured.

The results of the three tests, thermal fatigue test, tensile test at high temperature and oxidation test, are shown in Table 2.

As is apparent from the results of Table 2, sample Nos. 1-3 of the present invention were comparable to or better than conventional comparative samples Nos. 1-4 with respect to resistance to thermal fatigue and oxidation.

An exhaust manifold for a turbocharged gasoline engine with 1.8 L displacement was cast from each of the samples of the present invention. The productivity was excellent since a casting yield of at least 50% was attained without involving any casting defects such as misruns or pinholes.

As for machinability, the samples of the present invention could be made not harder than 200 in HB (Brinell hardness) by performing a heat treatment at a temperature not higher than the temperature of two-phase mixed region after casting. This hardness value was comparable to that of spheroidal graphite cast iron (FCD 40 in JIS), showing that the samples of the present invention are heat-resistant cast steels having satisfactory machinability.

The exhaust manifolds for a turbocharged gasoline engine with 1.8 L displacement that were made from selected samples of the present invention and comparative samples were set on the engine and subjected to a test of durability to evaluate their resistance to thermal fatigue. The chemical compositions of the manifolds under test are shown in Table 3. Comparative sample No. 1 shown in Table 3 was Ni-Resist spheroidal graphite cast iron; comparative sample No. 2 was high-Si spheroidal graphite cast iron; and comparative sample No. 3 was a kind of ferritic stainless cast steels commonly referred to as "CB-30" according to the ACI Standards.

The test of durability on engine was performed by repeating 500 heat cycles under full load conditions for a maximum rotational speed of 5600 rpm. The durability of the manifolds was evaluated by checking to see if thermal fatigue cracking occurred.

TABLE 3

| Specimen | | Chemical composition (wt %) | | | | | | | | | |
|---|---|---|---|---|---|---|---|---|---|---|---|
| | | C | N | Si | Mn | P | S | Cr | Mo | Ni | Nb |
| Sample No. | 1 | 0.08 | 0.022 | 0.87 | 0.45 | 0.018 | 0.009 | 18.9 | — | nil | 0.72 |
| | 2 | 0.15 | 0.067 | 1.25 | 0.48 | 0.016 | 0.010 | 19.7 | — | nil | 1.38 |
| Comparative sample No. | 1 | 2.19 | — | 4.92 | 0.38 | 0.022 | 0.008 | 1.9 | — | 34.7 | — |
| | 2 | 3.25 | — | 4.04 | 0.42 | 0.020 | 0.011 | nil | 0.58 | — | — |
| | 3 | 0.24 | — | 1.30 | 0.35 | 0.017 | 0.014 | 19.6 | — | nil | nil |

The exhaust manifolds fabricated from sample Nos. 1 and 2 of the present invention successfully withstood the 500 heat cycles without experiencing any thermal fatigue cracking, whereas the manifolds fabricated from comparative sample Nos. 1, 2 and 3 experienced wall-penetrating thermal fatigue cracking in 421, 365 and 432 heat cycles, respectively.

These result show that the products of the present invention were superior to the comparative products for reasons that the products of the present invention exhibited excellent resistance to thermal fatigue as exhaust manifolds that are to operate under hostile thermal load conditions.

EXAMPLE 2

This is an example of the present invention as set forth in claim 2. A total of seven specimens to be subjected to evaluation of various characteristics were prepared by casting; three of them were samples of the present invention designated Nos. 1–3 and the remaining four were comparative samples designated Nos. 1–4. The chemical compositions of the respective samples are shown in Table 4.

The casting materials of all samples were atmospherically-melted in a high-frequency 100 kg furnance, which were immediately followed by tapping at 1550° C. or more and pouring into the mold at 1500° C. or more to cast Y-shaped blocks of a size corresponding to JIS type A.

The castings were retained at 800° C. for 2 hours in a heating furnance and were subsequently cooled in air.

Comparative sample Nos. 1–4 shown in Table 4 were of those types which were used in heat-resistant parts such as automotive turbocharger housings and exhaust manifolds. Comparative sample No. 1 was high-Si spheroidal graphite cast iron; comparative sample No. 2 was a Ni-Resist spheroidal graphite cast iron; comparative sample No. 3 was CB-30 specified in the ACI (Alloy Casting Institute) Standards; and comparative sample No. 4 was a kind of austenitic heat-resistant cast steel (equivalent of JIS SCH 12).

The dash mark "-" in Table 4 means that no analysis was made.

TABLE 4

| Specimen | | Chemical composition (wt %) | | | | | | | | | |
|---|---|---|---|---|---|---|---|---|---|---|---|
| | | C | N | Si | Mn | P | S | Cr | Mo | Ni | Nb |
| Sample No. | 1 | 0.08 | 0.027 | 0.78 | 0.48 | 0.018 | 0.010 | 18.9 | 0.45 | nil | 0.74 |
| | 2 | 0.14 | 0.034 | 1.19 | 0.45 | 0.015 | 0.009 | 19.2 | 0.60 | nil | 1.30 |
| | 3 | 0.18 | 0.046 | 1.22 | 0.41 | 0.014 | 0.011 | 18.7 | 0.88 | nil | 1.57 |
| Comparative sample No. | 1 | 3.35 | — | 4.10 | 0.38 | 0.024 | 0.010 | nil | 0.59 | — | — |
| | 2 | 2.15 | — | 4.78 | 0.42 | 0.019 | 0.008 | 1.84 | — | 34.9 | — |
| | 3 | 0.27 | — | 1.35 | 0.37 | 0.021 | 0.011 | 19.5 | — | nil | nil |
| | 4 | 0.25 | — | 1.43 | 0.50 | 0.022 | 0.011 | 19.4 | — | 9.8 | — |

TABLE 5

| Specimen | | Creep (%) | Thermal fatigue life (cycles) | | Tensile test at high temp. | | | Oxidation test ($mg/cm^2$) |
|---|---|---|---|---|---|---|---|---|
| | | | 1st test run | 2nd test run | tensile strength ($kg/mm^2$) | yield strength ($kg/mm^2$) | elongation (%) | |
| Sample No. | 1 | 0.048 | 54 | 58 | 4.4 | 2.5 | 68 | 1 |
| | 2 | 0.038 | 63 | 55 | 5.0 | 2.9 | 59 | 1 |
| | 3 | 0.037 | 75 | 61 | 5.6 | 3.4 | 64 | 1 |

TABLE 5-continued

| Specimen | | Creep (%) | Thermal fatigue life (cycles) 1st test run | 2nd test run | Tensile test at high temp. tensile strength (kg/mm²) | yield strength (kg/mm²) | elongation (%) | Oxidation test (mg/cm²) |
|---|---|---|---|---|---|---|---|---|
| Comparative sample No. | 1 | 4.6 (27 hr) | 8 | 10 | 3.8 | 2.0 | 34 | 205 |
| | 2 | 0.11 | 22 | 24 | 8.5 | 4.1 | 45 | 19 |
| | 3 | 0.43 | 20 | 19 | 4.4 | 2.5 | 57 | 1 |
| | 4 | 0.008 | 37 | 32 | 13.1 | 7.2 | 28 | 2 |

The cast samples having the compositions shown in Table 4 were subjected to various evaluation tests as described below.

The samples were first subjected to a creep test using a creep tester. The test pieces had a distance of 50 mm between gage points and a diameter of 10 mm through gage points. They were held under a constant stress load of 0.64 kg/mm² in an inert gas atmosphere at 850° C. for 200 hours and the resulting creep was measured.

The samples were then subjected to a thermal fatigue test using a tester of an electrical-hydraulic servo system. The test pieces were round bars having a distance of 20 mm between gage points and a diameter of 10 mm through gage points With thermal elongation restricted completely by mechanical means, the test pieces were subjected to repeating heat cycles consisting of heating to 900° C. and cooling to 100° C., with one cycle being continued for 12 min, until they were broken by thermal fatigue.

With a view to analyzing factors that would govern resistance to thermal fatigue, all the specimens were subjected to a tensile test at 900° C. and an oxidation test which consisted of holding round bars (diameter: 14 mm, length: 80 mm) in air at 900° C. for 200 hours. After the oxidation test, the test pieces were shot-blasted to remove the oxide scale and the weight loss due to oxidation in terms of a change in weight per initial unit surface area (mg/cm²) was measured The results of the four tests, creep test, thermal fatigue test, tensile test at high temperature and oxidation test, are shown in Table 5.

As is apparent from the results of Table 5, sample Nos. 1–3 of the present invention were comparable to or better than conventional comparative samples Nos. 1–4 with respect to resistance to creep, thermal fatigue and oxidation.

An exhaust manifold and turbocharger housing for a turbocharged gasoline engine with 1.8 L displacement were cast from each of the samples of the present invention. The productivity was excellent since a casting yield of at least 50% was attained without involving any casting defects such as misruns or pinholes.

As for machinability, the samples of the present invention could be made not harder than 200 in HB (Brinell hardness) by performing a heat treatment at a temperature not higher than the temperature of two-phase mixed region after casting. This hardness value was comparable to that of spheroidal graphite cast iron (FCD 40 in JIS), showing that the samples of the present invention are heat-resistant cast steels having satisfactory machinability.

The exhaust manifolds and turbocharger housings for a turbocharged gasoline engine with 1.8 L displacement that were made from selected samples of the present invention and comparative samples were set on the engine and subjected to a test of durability to evaluate their resistance to thermal fatigue and deformation The chemical compositions of the manifolds and turbocharger housings under test are shown in Table 6. Comparative sample No. 1 shown in Table 6 was Ni-Resist spheroidal graphite cast iron; comparative sample No. 2 was high-Si spheroidal graphite cast iron; and comparative sample No. 3 was a kind of ferritic stainless cast steels commonly referred to as "CB-30" according to the ACI Standards.

The test of durability on engine was performed by repeating 500 heat cycles under full load conditions for a maximum rotational speed of 5600 rpm. The durability of the manifolds and turbocharger housings was evaluated by checking to see if thermal fatigue cracking occurred.

TABLE 6

| Specimen | | Chemical composition (wt %) C | N | Si | Mn | P | S | Cr | Mo | Ni | Nb |
|---|---|---|---|---|---|---|---|---|---|---|---|
| Sample No. | 1 | 0.08 | 0.022 | 0.87 | 0.45 | 0.018 | 0.009 | 18.9 | 0.42 | nil | 0.72 |
| | 2 | 0.15 | 0.067 | 1.25 | 0.48 | 0.016 | 0.010 | 19.7 | 0.76 | nil | 1.38 |
| Comparative sample No. | 1 | 2.19 | — | 4.92 | 0.38 | 0.022 | 0.008 | 1.9 | — | 34.7 | — |
| | 2 | 3.25 | — | 4.04 | 0.42 | 0.020 | 0.011 | nil | 0.58 | — | — |
| | 3 | 0.20 | — | 1.15 | 0.41 | 0.021 | 0.011 | 18.8 | — | nil | nil |

Each of the exhaust manifolds under the test of durability was combined with a turbocharger housing of the same material and the combination was set on the engine. When either part failed during the heat cycle test, only the failing part was replaced by a sound part of the same material and the test was continued.

The exhaust manifolds fabricated from sample Nos. 1 and 2 of the present invention successfully withstood the 500 heat cycles without experiencing any thermal fatigue cracking, whereas the manifolds fabricated from comparative sample Nos. 1, 2 and 3 experienced wall-penetrating thermal fatigue cracking in 421, 365 and 452 heat cycles, respectively.

The turbocharger housings fabricated from sample Nos. 1 and 2 of the present invention also successfully withstood the 500 heat cycles without experiencing any substantial deformation, nor did they experience any thermal fatigue cracking. In contrast, the turbocharger housing fabricated from comparative sample No. 1 experienced wall-penetrating thermal fatigue cracking in 435 heat cycles. The turbocharger housing fabricated from comparative sample No. 2 deformed considerably after 318 heat cycles and abnormal sound was heard on account of interference with the circumference of the rotor by the inside surfaces of the housing. The deformed housing was disassembled and its inside and outside surfaces were examined; oxide scale had formed extensively and in one of the most severely affected areas, the scale had come off the surface that extended over an area of 10 mm×10 mm. The turbocharger housing fabricated from comparative sample No. 3 also deformed considerably after 449 heat cycles and abnormal sound was heard on account of interference with the circumference of the rotor by the inside surfaces of the housing. The deposition of oxide scale was negligible.

These results show that the products of the present invention were superior to the comparative products for reasons that the products of the present invention exhibited higher resistance to thermal fatigue and creep as exhaust manifolds and turbocharger housings that are to operate under hostile thermal load conditions.

EXAMPLE 3

This is an example of the present invention as set forth in claim 3. A total of nineteen specimens to be subjected to evaluation of various characteristics were prepared by casting; sixteen of them were samples of the present invention designated Nos. 1-16 and the remaining three were comparative samples designated Nos. 1-3. The chemical compositions of the respective samples are shown in Table 7.

The casting materials of all samples were atmospherically-melted in a high-frequency 100 kg furnance, which were immediately followed by tapping at 1550° C. or more and pouring into the mold at 1500° C. or more to cast Y-shaped blocks of a size corresponding to JIS type A.

The castings were then subjected to a heat treatment which were retained at 800° C. for 2 hours in a heating furnance and were subsequently cooled in air.

Comparative sample Nos. 1-3 shown in Table 7 were of those types which were used in parts such as automotive turbocharger housings and exhaust manifolds. Comparative sample No. 1 was a Ni-Resist spheroidal graphite cast iron; comparative sample No. 2 was an austenitic heat-resistant cast steel (equivalent of JIS SCH 12); and comparative sample No. 3 was a kind of cast irons commonly referred to as "high-Si spheroidal graphite cast iron".

The dash mark "-" in Table 7 means that no analysis was made.

The cast samples having the compositions shown in Table 7 were subjected to various evaluation tests as described below.

The samples were first subjected to a thermal fatigue test using a tester of an electrical-hydraulic servo system. The test pieces were round bars having a distance of 20 mm between gage points and a diameter of 10 mm through gage points. With thermal elongation restricted completely by mechanical means, the test pieces were subjected to repeating heat cycles consisting of heating to 900° C. and cooling to 100° C., with one cycle being continued for 12 min, until they were broken by thermal fatigue.

With a view to analyzing factors that would govern resistance to thermal fatigue, all the specimens were subjected to a tensile test at 900° C. and an oxidation test which consisted of holding round bars (diameter: 14 mm, length: 80 mm) in air at 900° C. for 200 hours. After the oxidation test, the test pieces were shot-blasted to remove the oxide scale and the weight loss due to oxidation in terms of a change in weight per initial unit surface area (mg/cm$^2$) was measured The results of the three tests, thermal fatigue test, tensile test at high temperature and oxidation test, are shown in Table 8.

As is apparent from the results of Table 8, sample Nos. 1-16 of the present invention were comparable to or better than conventional comparative samples Nos. 1-3 with respect to resistance to thermal fatigue and oxidation.

TABLE 7

| Specimen | | Chemical composition (wt %) | | | | | | | | | |
|---|---|---|---|---|---|---|---|---|---|---|---|
| | | C | N | Si | Mn | P | S | Cr | Ti | Mo | Ni |
| Sample No. | 1 | 0.07 | 0.018 | 0.82 | 0.44 | 0.011 | 0.003 | 16.1 | 0.02 | 0.22 | 0.09 |
| | 2 | 0.06 | 0.023 | 1.41 | 0.36 | 0.009 | 0.003 | 15.8 | 0.01 | 0.65 | 0.33 |
| | 3 | 0.08 | 0.031 | 1.55 | 0.66 | 0.016 | 0.003 | 20.1 | 0.07 | 0.33 | 0.54 |
| | 4 | 0.06 | 0.017 | 0.97 | 0.47 | 0.012 | 0.004 | 21.8 | 0.08 | 0.70 | 0.08 |
| | 5 | 0.09 | 0.072 | 0.47 | 0.41 | 0.014 | 0.003 | 18.6 | 0.02 | 0.25 | 0.66 |
| | 6 | 0.11 | 0.086 | 1.67 | 0.49 | 0.014 | 0.004 | 20.9 | 0.01 | 0.68 | 0.12 |
| | 7 | 0.07 | 0.064 | 1.73 | 0.77 | 0.011 | 0.003 | 17.1 | 0.07 | 0.21 | 0.01 |
| | 8 | 0.07 | 0.092 | 0.91 | 0.39 | 0.014 | 0.005 | 17.3 | 0.08 | 0.73 | 0.66 |
| | 9 | 0.15 | 0.032 | 0.74 | 0.48 | 0.017 | 0.003 | 20.4 | 0.01 | 0.33 | 0.70 |
| | 10 | 0.16 | 0.024 | 1.14 | 0.51 | 0.009 | 0.003 | 19.9 | 0.02 | 0.81 | 0.07 |
| | 11 | 0.20 | 0.036 | 1.26 | 0.42 | 0.010 | 0.004 | 17.8 | 0.06 | 0.27 | 0.08 |
| | 12 | 0.17 | 0.027 | 0.78 | 0.39 | 0.012 | 0.003 | 17.6 | 0.09 | 0.91 | 0.41 |
| | 13 | 0.17 | 0.066 | 0.86 | 0.57 | 0.013 | 0.005 | 18.1 | 0.02 | 0.28 | 0.12 |
| | 14 | 0.17 | 0.071 | 1.47 | 0.39 | 0.011 | 0.003 | 15.7 | 0.01 | 0.87 | 0.78 |
| | 15 | 0.19 | 0.082 | 1.51 | 0.68 | 0.014 | 0.003 | 19.8 | 0.10 | 0.31 | 0.89 |
| | 16 | 0.18 | 0.064 | 0.69 | 0.52 | 0.016 | 0.004 | 21.3 | 0.07 | 0.69 | 0.07 |
| Comparative sample No. | 1 | 2.20 | — | 4.84 | 0.39 | — | — | 1.88 | nil | — | 34.5 |
| | 2 | 0.21 | — | 1.27 | 0.40 | — | — | 18.7 | nil | — | 9.0 |
| | 3 | 3.37 | — | 4.08 | 0.40 | — | — | nil | nil | 0.61 | nil |

TABLE 8

| Specimen | | Thermal fatigue life (cycles) 1st test run | 2nd test run | Tensile test at high temp. tensile strength ($kg/mm^2$) | yield strength ($kg/mm^2$) | elongation (%) | Oxidation test ($mg/cm^2$) |
|---|---|---|---|---|---|---|---|
| Sample No. | 1 | 19 | 21 | 2.7 | 1.3 | 81 | 1 |
| | 2 | 35 | 31 | 3.4 | 1.8 | 86 | 1 |
| | 3 | 42 | 36 | 3.1 | 1.7 | 80 | 1 |
| | 4 | 23 | 24 | 3.0 | 1.7 | 84 | 1 |
| | 5 | 85 | 92 | 4.1 | 2.4 | 83 | 1 |
| | 6 | 112 | 124 | 4.9 | 3.1 | 80 | 2 |
| | 7 | 71 | 88 | 3.8 | 2.2 | 89 | 1 |
| | 8 | 129 | 116 | 4.9 | 3.2 | 89 | 1 |
| | 9 | 46 | 38 | 3.3 | 1.8 | 59 | 2 |
| | 10 | 49 | 41 | 3.4 | 2.2 | 56 | 2 |
| | 11 | 51 | 59 | 3.8 | 2.1 | 47 | 2 |
| | 12 | 58 | 51 | 3.9 | 2.5 | 52 | 1 |
| | 13 | 99 | 91 | 3.4 | 2.4 | 58 | 2 |
| | 14 | 107 | 96 | 4.2 | 3.1 | 59 | 1 |
| | 15 | 117 | 124 | 4.5 | 2.7 | 57 | 2 |
| | 16 | 102 | 97 | 4.1 | 2.5 | 53 | 2 |
| Comparative sample No. | 1 | 17 | 18 | 9.0 | 4.0 | 43 | 20 |
| | 2 | 20 | 31 | 12.0 | 7.0 | 25 | 2 |
| | 3 | 9 | 7 | 4.0 | 2.0 | 32 | 180 |

Figure 2:
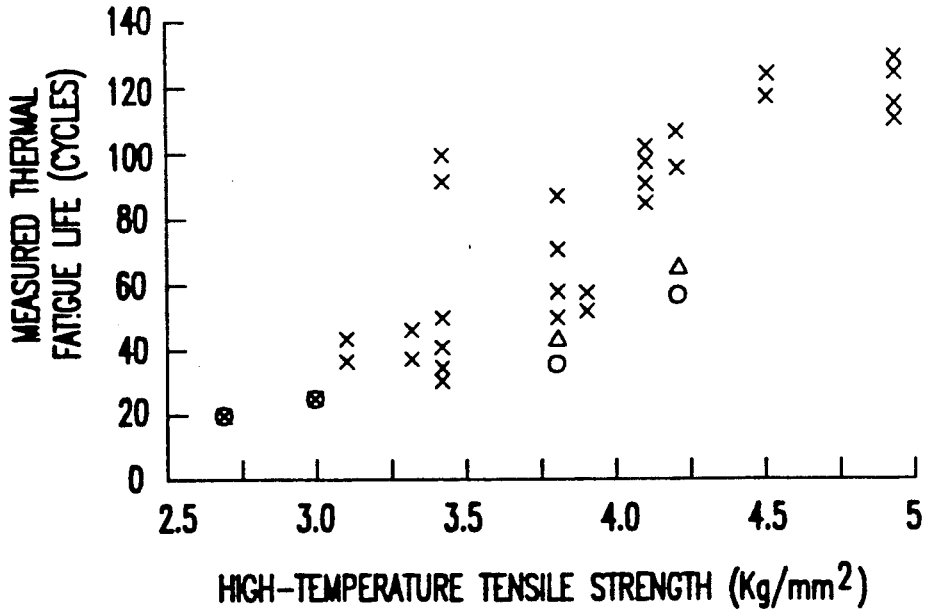
FIG. 2 is a graph showing the relationship between the tensile strength at 900° C. and measured values of thermal fatigue life.
Figure 3:
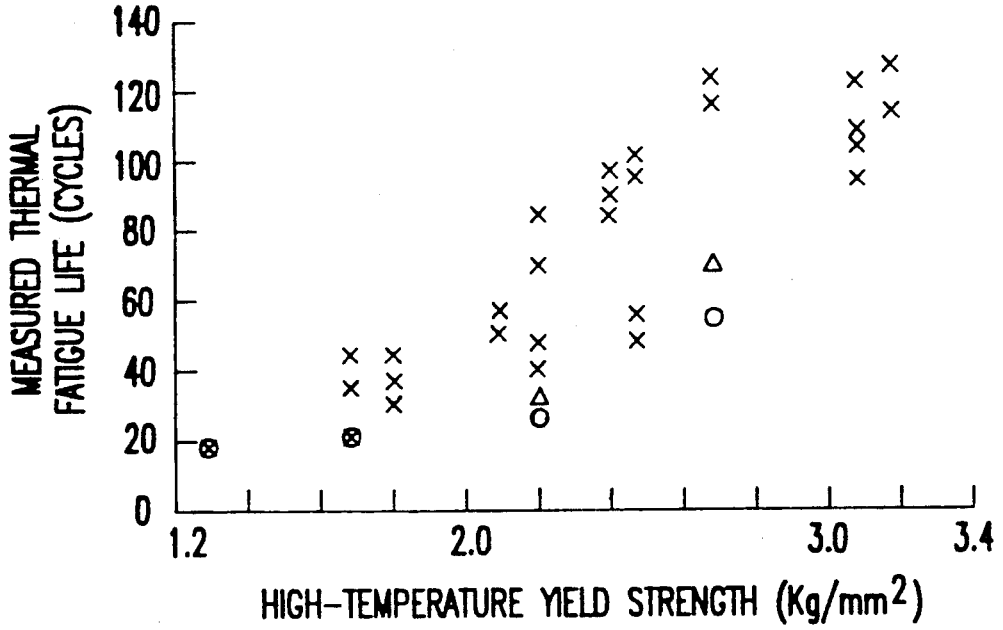
FIG. 3 is a graph showing the relationship between the yield strength at 900° C. and measured values of thermal fatigue life.
Figure 4:
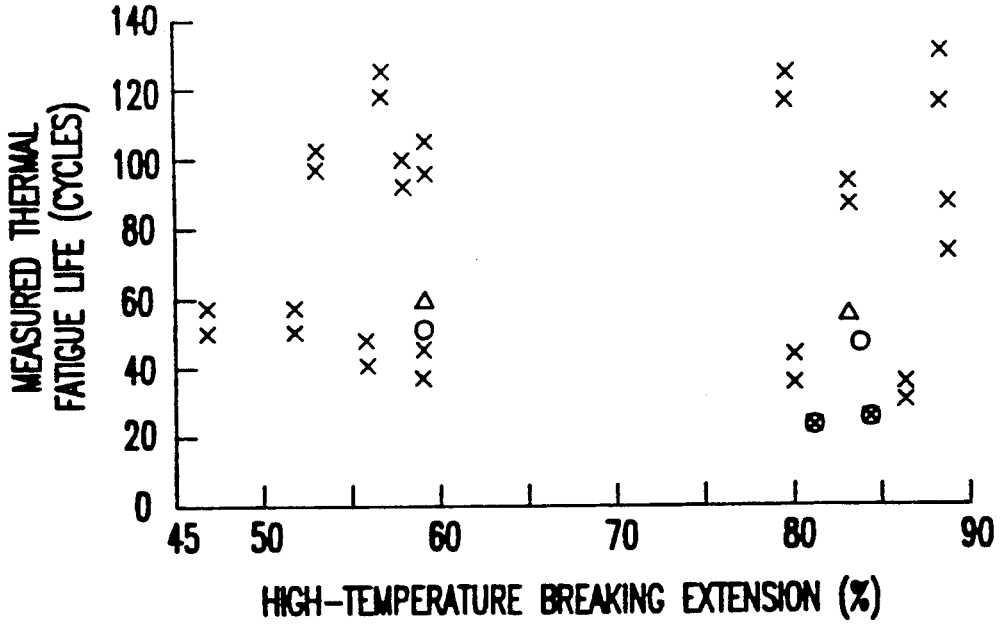
FIG. 4 is a graph showing the relationship between the breaking extension at 900° C. and measured values of thermal fatigue life.

In order to make further investigation on thermal fatigue resistance, the correlation between chemical composition and physical/mechanical characteristics was studied by statistical techniques including multiple regression analysis The results are shown in FIGS. 1–4 FIG. 1 is a graph showing the relationship between values of thermal fatigue life as estimated by the equation of multiple regression and measured values; FIG. 2 is a graph showing the relationship between the tensile strength at 900° C. and measured values of thermal fatigue life; FIG. 3 is a graph showing the relationship between the yield strength at 900° C. and measured values of thermal fatigue life; and FIG. 4 is a graph showing the relationship between the breaking extension at 900° C. and measured values of thermal fatigue life. The symbols used in each drawing refer to the following:

X: when retained at a temperature not higher than the temperature of two-phase mixed region and then cooled:

Δ: when retained at the temperature of two-phase mixed region and then cooled:

○: as-cast specimen.

The equation of thermal fatigue life of the samples of the present invention was estimated by the following regression:

$$Hf = 1290 \times (N\ wt\ \%) + 103 \times (C\ wt\ \%) + 14 \times (Mo\ wt\ \%) - 16$$

$R^2 = 0.98$

Where

Hf: thermal fatigue life $R^2$: determinative coefficient (N wt %) : N content (by weight)

(C wt %) : C content (by weight)

(Mo wt %): Mo content (by weight)

The results of statistical analyses show that with the ferritic stainless cast steels of the type contemplated by the present invention, strength (e.g. yield strength) at high temperatures is a more predominant factor to govern thermal fatigue resistance than breaking extension which has conventionally been held important. It is also seen that to insure high strength at high temperatures, it is effective to increase the contents of C, N and Mo within ranges that will not impair any other necessary characteristics of the cast steel.

An exhaust manifold for a turbocharged gasoline engine with 1.8 L displacement was cast from each of the samples of the present invention. The productivity was excellent since a casting yield of at least 50% was attained without involving any casting defects such as misruns or pinholes.

As for machinability, the samples of the present invention could be made not harder than 200 in HB (Brinell hardness) by performing a heat treatment at a temperature not higher than the temperature of two-phase mixed region after casting. This hardness value was comparable to that of spheroidal graphite cast iron (FCD 40 in JIS), showing that the samples of the present invention are heat-resistant cast steels having satisfactory machinability.

The exhaust manifolds for a turbocharged gasoline engine with 1.8 L displacement that were made from selected samples of the present invention and comparative samples were set on the engine and subjected to a test of durability to evaluate their resistance to thermal fatigue. The chemical compositions of the manifolds under test are shown in Table 9. Comparative sample No. 1 shown in Table 9 was Ni-Resist spheroidal graphite cast iron; and comparative sample No. 2 was a kind of cast irons commonly referred to as high-Si spheroidal graphite cast iron.

TABLE 9

| Specimen | | Chemical composition (wt %) C | N | Si | Mn | P | S | Cr | Ti | Mo | Ni |
|---|---|---|---|---|---|---|---|---|---|---|---|
| Sample No. | 1 | 0.07 | 0.018 | 0.70 | 0.41 | 0.014 | 0.003 | 17.3 | 0.02 | 0.22 | 0.07 |
| | 2 | 0.17 | 0.071 | 1.67 | 0.45 | 0.016 | 0.003 | 19.1 | 0.07 | 0.70 | 0.74 |
| Comparative | 1 | 2.30 | — | 4.79 | 0.40 | — | — | 1.79 | — | — | 34.7 |
| | 2 | 3.29 | — | 3.91 | — | — | — | — | — | 0.52 | — |

TABLE 9-continued

| Specimen | Chemical composition (wt %) | | | | | | | | | |
|---|---|---|---|---|---|---|---|---|---|---|
| | C | N | Si | Mn | P | S | Cr | Ti | Mo | Ni |
| sample No. | | | | | | | | | | |

The test of durability on engine was performed by repeating 500 heat cycles under full load conditions for a maximum rotational speed of 5600 rpm. The durability of the manifolds was evaluated by checking to see if thermal fatigue cracking occurred.

The exhaust manifolds fabricated from sample Nos. 1 and 2 of the present invention successfully withstood the 500 heat cycles without experiencing any thermal fatigue cracking, whereas the manifolds fabricated from comparative sample Nos. 1, and 2 experienced wall-penetrating thermal fatigue cracking in 421, and 365 heat cycles, respectively.

These result show that the products of the present invention were superior to the comparative products for reasons that the products of the present invention exhibited excellent resistance to thermal fatigue as exhaust manifolds that are to operate under hostile thermal load conditions.

EXAMPLE 4

This is an example of the present invention as set forth in claim 4. A total of six specimens to be subjected to evaluation of various characteristics were prepared by casting; three of them were samples of the present invention designated Nos. 1-3 and the remaining three were comparative samples designated Nos. 1-3. The chemical compositions of the respective samples are shown in Table 10.

The casting materials of all samples were atmospherically-melted in a high-frequency 100 kg furnance, which were immediately followed by tapping at 1550° C. or more and pouring into the mold at 1500° C. or more to cast Y-shaped blocks of a size corresponding to JIS type A.

The castings were retained at 800° C. for 2 hours in a heating furnance and were subsequently cooled in air.

Comparative sample Nos. 1-3 shown in Table 10 were of those types which were used in heat-resistant parts such as automotive turbocharger housings and exhaust manifolds. Comparative sample No. 1 was a Ni-Resist spheroidal graphite cast iron; comparative sample No. 2 was a kind of austenitic heat-resistant cast steel (equivalent of JIS SCH 12).

The dash mark "-" in Table 10 means that no analysis was made.

TABLE 10

| Specimen | | Chemical composition (wt %) | | | | | | | | | | |
|---|---|---|---|---|---|---|---|---|---|---|---|---|
| | | C | N | Si | Mn | P | S | Cr | Ti | Mo | Ni | Nb |
| Sample No. | 1 | 0.06 | 0.021 | 1.43 | 0.30 | 0.008 | 0.004 | 16.8 | 0.01 | 0.55 | 0.38 | 0.05 |
| | 2 | 0.11 | 0.088 | 1.37 | 0.49 | 0.014 | 0.004 | 19.9 | 0.01 | 0.58 | 0.12 | 0.10 |
| | 3 | 0.19 | 0.052 | 1.59 | 0.78 | 0.014 | 0.003 | 17.8 | 0.16 | 0.34 | 0.99 | 1.2 |
| Compara- | 1 | 2.20 | — | 4.84 | 0.39 | — | — | 1.88 | nil | — | 34.5 | — |
| tive | 2 | 0.21 | — | 1.27 | 0.40 | — | — | 18.7 | nil | — | 9.0 | — |
| sample No. | 3 | 3.37 | — | 4.08 | 0.40 | — | — | nil | nil | 0.61 | nil | — |

TABLE 11

| Specimen | | Thermal fatigue life (cycles) | | Tensile test at high temp. | | | Oxidation test |
|---|---|---|---|---|---|---|---|
| | | 1st test run | 2nd test run | tensile strength (kg/mm²) | yield strength (kg/mm²) | elongation (%) | (mg/cm²) |
| Sample No. | 1 | 18 | 23 | 5.2 | 2.3 | 47 | 1 |
| | 2 | 33 | 35 | 4.3 | 3.1 | 52 | 1 |
| | 3 | 39 | 38 | 4.9 | 1.8 | 39 | 1 |
| Comparative | 1 | 17 | 18 | 9.0 | 4.0 | 43 | 20 |
| sample No. | 2 | 20 | 31 | 12.0 | 7.0 | 25 | 2 |
| | 3 | 9 | 7 | 4.0 | 2.0 | 32 | 180 |

The cast samples having the compositions shown in Table 10 were subjected to various evaluation tests as described below.

The samples were first subjected to a thermal fatigue test using a tester of an electrical-hydraulic servo system. The test pieces were round bars having a distance of 20 mm between gage points and a diameter of 10 mm through gage points. With thermal elongation restricted completely by mechanical means, the test pieces were subjected to repeating heat cycles consisting of heating to 900° C. and cooling to 100° C., with one cycle being continued for 12 min, until they were broken by thermal fatigue.

With a view to analyzing factors that would govern resistance to thermal fatigue, all the specimens were subjected to a tensile test at 900° C. and an oxidation test which consisted of holding round bars (diameter: 14 mm, length: 80 mm) in air at 900° C. for 200 hours. After the oxidation test, the test pieces were shot-blasted to remove the oxide scale and the weight loss due to oxidation in terms of a change in weight per initial unit surface area (mg/cm²) was measured.

The results of the three tests, thermal fatigue test, tensile test at high temperature and oxidation test, are shown in Table 11.

As is apparent from the results of Table 11, sample Nos. 1-3 of the present invention were comparable to or better than conventional comparative samples Nos. 1-3 with respect to resistance to thermal fatigue and oxidation.

An exhaust manifold for a turbocharged gasoline engine with 1.8 L displacement was cast from each of the samples of the present invention. The productivity was excellent since a casting yield of at least 50% was attained without involving any casting defects such as misruns or pinholes.

As for machinability, the samples of the present invention could be made not harder than 200 in HB (Brinell hardness) by performing a heat treatment at a temperature not higher than the temperature of two-phase mixed region after casting. This hardness value was comparable to that of spheroidal graphite cast iron (FCD 40 in JIS), showing that the samples of the present invention are heat-resistant cast steels having satisfactory machinability.

The exhaust manifolds for a turbocharged gasoline engine with 1.8 L displacement that were made from selected samples of the present invention and comparative samples were set on the engine and subjected to a test of durability to evaluate their resistance to thermal fatigue. The chemical compositions of the manifolds under test are shown in Table 12. Comparative sample No. 1 shown in Table 12 was Ni-Resist spheroidal graphite cast iron; and comparative sample No. 2 was a kind of cast irons commonly referred to as high-Si spheroidal graphite cast iron.

The test of durability on engine was performed by repeating 500 heat cycles under full load conditions for a maximum rotational speed of 5600 rpm. The durability of the manifolds was evaluated by checking to see if thermal fatigue cracking occurred.

TABLE 12

| Specimen | | Chemical composition (wt %) | | | | | | | | | | |
|---|---|---|---|---|---|---|---|---|---|---|---|---|
| | | C | N | Si | Mn | P | S | Cr | Ti | Mo | Ni | Nb |
| Sample No. | 1 | 0.07 | 0.028 | 0.90 | 0.45 | 0.010 | 0.003 | 17.8 | 0.02 | 0.43 | 0.08 | 0.10 |
| | 2 | 0.16 | 0.073 | 1.09 | 0.60 | 0.006 | 0.003 | 20.1 | 0.06 | 0.65 | 0.24 | 1.95 |
| Comparative sample No. | 1 | 2.30 | — | 4.79 | 0.40 | — | — | 1.79 | — | — | 34.7 | — |
| | 2 | 3.29 | — | 3.91 | — | — | — | — | — | 0.52 | — | — |

The exhaust manifolds fabricated from sample Nos. 1 and 2 of the present invention successfully withstood the 500 heat cycles without experiencing any thermal fatigue cracking, whereas the manifolds fabricated from comparative sample Nos. 1, and 2 experienced wall-penetrating thermal fatigue cracking in 421, and 365 heat cycles, respectively.

These result show that the products of the present invention were superior to the comparative products for reasons that the products of the present invention exhibited excellent resistance to thermal fatigue as exhaust manifolds that are to operate under hostile thermal load conditions.

As described on the foregoing pages, a desired superior heat-resistant cast steel can be produced at low cost according to the present invention and said cast steel of the present invention performs better than conventional heat-resistant cast steels with respect to thermal fatigue and oxidation resistance, which are two particularly important requirements for parts of an engine exhaust system, and it yet exhibits comparable characteristics to conventional heat-resistant cast irons with respect to castability and machinability. Thus, the heat-resistant cast steel of the present invention is anticipated to attain excellent results when applied as materials of parts of an engine exhaust system.

While the invention has been described in detail and with reference to specific embodiments thereof, it will be apparent to one skilled in the art that various changes and modifications can be made therein without departing from the spirit and scope thereof.

What is claimed is:

1. A method of producing an end product having at least one thin-walled section, comprising the steps of:

preparing a mold having a cavity similar in shape to the end product;

casting a body in said mold using a heat resistant cast steel material consisting essentially of, on a weight basis, 0.06%-0.20% C, 0.01%-0.10% N, 0.4%-2.0% Si, 0.3%-1.0% Mn, not more than 0.04% P, not more than 0.04% S, 15%-22% Cr, 0.01%-2.0% Nb, with a balance being Fe and incidental impurities; and finishing the end product without further forming operations.

2. A method of producing an end product having at least one thin-walled section, comprising the steps of:

preparing a mold having a cavity similar in shape to the end product;

casting a body in said mold using a heat resistant cast steel material consisting essentially of, on a weight basis, 0.06%-0.20% C, 0.01%-0.10% N, 0.4%-2.0% Si, 0.3%-1.0% Mn, not more than 0.04% P, not more than 0.04% S, 15%-22% Cr, 0.01%-2.0% Nb, 0.2%-1.0% Mo, with a balance being Fe and incidental impurities; and finishing the end product without further forming operations.

3. A method of producing an end product having at least one thin-walled section, comprising the steps of:

preparing a mold having a cavity similar in shape to the end product;

casting a body in said mold using a heat resistant cast steel material consisting essentially of, on a weight basis, 0.06%-0.20% C, 0.01%-0.10% N, 0.4%-2.0% Si, 0.3%-1.0% Mn, not more than 0.04% P, not more than 0.04% S, 15%-22% Cr, 0.01%-0.10% Ti, 0.2%-1.0% Mo, 0.01%-1.0 Ni, with a balance being Fe and incidental impurities; and finishing the end product without further forming operations.

4. A method of producing an end product having at least one thin-walled section, comprising the steps of:

preparing a mold having a cavity similar in shape to the end product;

casting a body in said mold using a heat resistant cast steel material consisting essentially of, on a weight basis, 0.06%-0.20% C, 0.01%-0.10% N, 0.4%-2.0% Si, 0.3%-1.0% Mn, not more than 0.04% P, not more than 0.04% S, 15%-22% Cr, 0.01%-2.0% Nb, 0.01%-0.10% Ti, 0.2%-1.0% Mo, 001%-1.0% Ni, with a balance being Fe and incidental impurities; and finishing the end product without further forming operations.

5. The method as claimed in any of claims 1-4 wherein the mold is prepared so that the shape of the cavity is selected from the shapes of a manifold, housing and chamber.

* * * * *

UNITED STATES PATENT AND TRADEMARK OFFICE

CERTIFICATE OF CORRECTION

PATENT NO. : 5,106,578

DATED : April 21, 1992

INVENTOR(S) : Kouki Ohtsuka et al.

It is certified that error appears in the above-indentified patent and that said Letters Patent is hereby corrected as shown below:

Title page, item [54] and column 1, line 3, after "CAST STEEL" insert --, AND METHOD OF MAKING SAME--.

Title page, item [73], change "Hitachi Metals Ltd." to --Hitachi Metals, Ltd.--.

Title page, Abstract, line 19, change "comprises" to --comprises,--.

Title page, Abstract, line 31, after "Cr," insert --0.01-2.0% Nb,--.

Claim 3, column 18, line 46, change "1.0 Ni" to -- 1.0% Ni--.

Claim 4, column 18, line 61, change "001%" to --0.01%--.

Signed and Sealed this

Eighth Day of March, 1994

Bruce Lehman

*Attest:*

BRUCE LEHMAN

*Attesting Officer*

*Commissioner of Patents and Trademarks*